US011767485B2

(12) United States Patent
Soga et al.

(10) Patent No.: US 11,767,485 B2
(45) Date of Patent: Sep. 26, 2023

(54) AQUEOUS DIE LUBRICANT FOR DIE CASTING

(71) Applicant: YUSHIRO CHEMICAL INDUSTRY CO., LTD., Tokyo (JP)

(72) Inventors: Koji Soga, Koza-gun (JP); Toshiaki Noguchi, Koza-gun (JP); Makoto Ishikawa, Koza-gun (JP)

(73) Assignee: YUSHIRO CHEMICAL INDUSTRY CO., LTD., Tokyo (JP)

( * ) Notice: Subject to any disclaimer, the term of this patent is extended or adjusted under 35 U.S.C. 154(b) by 0 days.

(21) Appl. No.: 17/917,589

(22) PCT Filed: Apr. 8, 2021

(86) PCT No.: PCT/JP2021/014898

§ 371 (c)(1),
(2) Date: Oct. 7, 2022

(87) PCT Pub. No.: WO2021/206141

PCT Pub. Date: Oct. 14, 2021

(65) Prior Publication Data

US 2023/0145091 A1 May 11, 2023

(30) Foreign Application Priority Data

Apr. 10, 2020 (JP) ..... 2020-070899

(51) Int. Cl.
*C10M 125/30* (2006.01)
*B22C 3/00* (2006.01)
(Continued)

(52) U.S. Cl.
CPC ..... *C10M 125/30* (2013.01); *B22C 3/00* (2013.01); *C10M 173/00* (2013.01);
(Continued)

(58) Field of Classification Search
CPC ..... C10M 125/30; C10M 173/00; C10M 2201/103; C10N 2020/06; C10N 2040/24; B22C 3/00
See application file for complete search history.

(56) References Cited

U.S. PATENT DOCUMENTS

2001/0031707 A1 10/2001 Maeda et al.
2002/0022580 A1 2/2002 Fukunaga et al.
(Continued)

FOREIGN PATENT DOCUMENTS

JP 9-66340 A 3/1997
JP 2001-259788 A 9/2001
(Continued)

OTHER PUBLICATIONS

International Search Report dated May 18, 2021, issued in counterpart International Application No. PCT/JP2021/014898 (2 pages).

*Primary Examiner* — Vishal V Vasisth
(74) *Attorney, Agent, or Firm* — WHDA, LLP

(57) ABSTRACT

With excellent heat retention of molten metal and better productivity/work environment, regardless of low-speed or high-speed, the usable die lubricant for die casting will be provided. An aqueous die lubricant for die casting in which a phyllosilicate mineral is dispersed at a concentration of 0.005 wt % or more and less than 5 wt % and has a particle diameter of 0.1 μm or less during the dispersion.

6 Claims, 1 Drawing Sheet

(51) Int. Cl.

| | |
|---|---|
| ***C10M 173/00*** | (2006.01) |
| *C10N 20/06* | (2006.01) |
| *C10N 40/24* | (2006.01) |
| *C10N 20/00* | (2006.01) |

(52) U.S. Cl.
CPC ... *C10M 2201/103* (2013.01); *C10N 2020/00* (2013.01); *C10N 2040/24* (2013.01)

(56) References Cited

U.S. PATENT DOCUMENTS

| | | | | |
|---|---|---|---|---|
| 2003/0130139 | A1* | 7/2003 | Komiyama ..... | C10M 141/02<br>508/183 |
| 2009/0014145 | A1 | 1/2009 | Stotzel et al. | |

FOREIGN PATENT DOCUMENTS

| | | | |
|---|---|---|---|
| JP | 2001-353550 | A | 12/2001 |
| JP | 2008-523991 | A | 7/2008 |
| JP | 4464214 | B2 | 5/2010 |

* cited by examiner

AQUEOUS DIE LUBRICANT FOR DIE CASTING

This application is a 371 of PCT/JP2021/014898, filed Apr. 8, 2021.

TECHNICAL FIELD

The present invention relates to an aqueous die lubricant for low-speed and high-speed die casting, and particularly relates to a die lubricant excellent in heat retention of molten metal and low accumulation characteristics and also in retaining a good work environment.

BACKGROUND ART

In die casting such as aluminum die casting, die lubricants are applied to the molding surface of molds per molding cycle in order to prevent soldering between the mold and the cast product made of solidified molten metal and to take castings away from the molds without damaging them. The die lubricants are broadly classified into aqueous-types (dispersion medium: water), oil-types (dispersion medium: hydrocarbon liquid) and powder-types (nonsolvent) according to the existence/nonexistence and the kinds of dispersion media. Any of these die lubricants contain wax, esters, silicone oils, etc., all of which are heat resistant, as a lubricant ingredient. Inorganic lubricants such as graphite, talc and mica are sometimes used as a solid lubricant for the purpose of giving higher heat resistance.

Although the oil-type is generally said to be excellent in mold releasablity among the die lubricants, it can be used only on rare occasions for fear of fuming and ignition. The powder-type has an advantage in reducing wastes such as various waste water, but has some difficulties in cooling a mold in itself, in controlling the concentration of the die lubricant, and in preparing a special application facility or equipment. The aqueous-type die lubricant is easily applied to and simultaneously cool the mold, so that it is now most commonly used as a die lubricant for die casting.

Regarding an aqueous die lubricant for die casting, PTL 1 discloses an aqueous die lubricant for low-speed injection die casting, which is prepared by using a specific thixotropic clay mineral and a specific high molecular weight organic compound together and then adding an ion-repelling dispersing agent and water thereto. The foregoing specific clay mineral is expected to increase heat retention of molten metal and to ensure a good run of it. And the amount of gas generated is so small that the specific clay mineral can assure the internal quality.

However, in terms of stability, clay minerals in general have a lot of disadvantages due to poor dispersibility in water. To be specific, because of the rapid sedimentation rate, maintenance and productivity problems, such as sedimentation in the piping and nozzle clogging, tend to take place. The specific high molecular weight organic compound and dispersing agent described in PTL 1 contribute to the dispersion stability of the clay mineral in a state of an undiluted solution, but a water dilution thereof, which is a form actually used, significantly lowers the dispersion effect and cannot solve the above problems. In addition, the high molecular weight organic compound and the dispersing agent are thermally decomposed and gasified quite easily on contact with high temperature molten metal, which might be one reason for the deterioration of the internal quality of the products.

Therefore it is common that die lubricants comprising clay minerals are used only in the case that heat retention of molten metal is primarily required, especially for low-speed die casting and so on.

CITATION LIST

Patent Literature

PTL 1: JP 4464214 B

SUMMARY OF INVENTION

Technical Problem

As described above, while taking advantage of their characteristics, aqueous-type die lubricants used in combination with inorganic lubricants and high molecular weight organic compounds should meet the following proposals: to deal with new types of alloys, such as high-performance alloys that have been developed recently; to be adapted to new production methods such as low-speed die casting for the purpose of improving the internal quality of products; to comply with the recent demand for the process of manufacturing precision-cast products, i.e., effectively producing more complicated shapes.

An object of the present invention is to provide a die lubricant for die casting with excellent heat retention of molten metal to improve productivity/work environment. Therefore, regardless of low-speed or high-speed die casting, the die lubricant for die casting is usable.

Solution to Problem

In the aqueous die lubricant for die casting of the present invention, a specific phyllosilicate mineral is dispersed at a concentration of 0.005 wt % or more and less than 5 wt % and has a particle diameter of 0.1 μm or less during the dispersion.

It is preferable that the phyllosilicate mineral should be smectite.

Advantageous Effects of Invention

The present invention is characterized in that the aqueous die lubricant comprises a specific phyllosilicate mineral which is stable and transparently dispersible in water. The aqueous die lubricant can always keep the undiluted liquid or the diluted in a stable liquid state without mixing dispersing agents which may cause deterioration of internal quality after they are gasified. In the present invention, a film of the die lubricant formed by applying the aqueous die lubricant to a mold achieves an excellent run of molten metal due to good heat retention of molten metal from a specific phyllosilicate mineral; prevents soldering due to high heat resistance; and suppresses the gas generation, which prevents deterioration of the internal quality of the products, such as cavity and swelling. Additionally, the aqueous mold-releasing of the present invention keeps the liquid state stable and successfully prevents precipitation and sedimentation in pipings, which contributes to improving productivity and workability. The aqueous die lubricant, which is dispersed in water again easily even after dried, prevents dirt from accumulating in a machine and its surrounding area.

Due to the above advantages, the aqueous die lubricant of the present invention can raise product quality and manufacturing efficiency and is preferably used for both high-speed and low-speed die casting.

DESCRIPTION OF EMBODIMENTS

Figure 1:
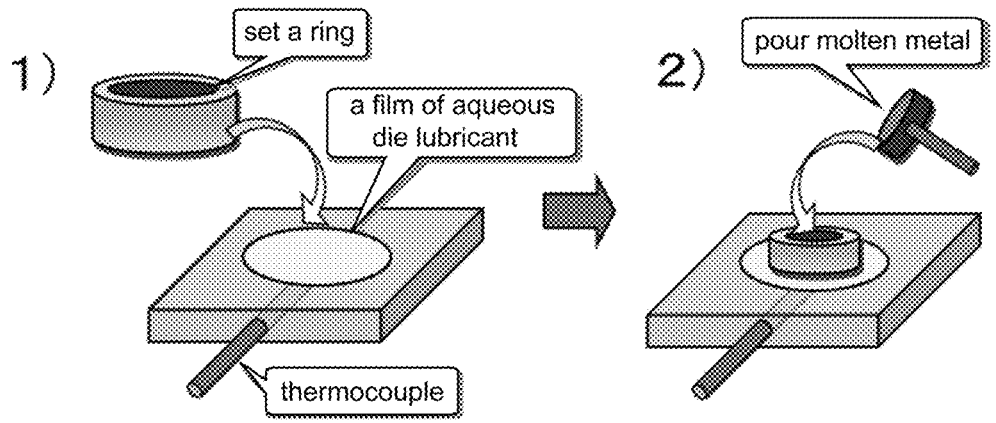
FIG. 1 is a schematic diagram explaining a method of evaluating the thermal insulation performance.

Hereinafter, an aqueous die lubricant for die casting of the present invention is described in detail.

In the aqueous die lubricant for die casting of the present invention (hereinafter referred to simply as the "aqueous die lubricant"), a phyllosilicate mineral is dispersed at a concentration of 0.005 wt % or more and less than 5 wt % and has a particle diameter of 0.1 μm or less during the dispersion.

Phyllosilicate minerals are main minerals of clay minerals and are composed of minute particles. The phyllosilicate mineral includes kaolinite, pyrophyllite, smectite (saponite, hectorite, stevensite, beidellite), vermiculite, mica clay mineral (illite, sericite), talc, gluconate and chlorite.

Besides the foregoing phyllosilicate minerals, the clay mineral includes crystalline aluminosilicate having micro pores, such as zeolite, and hydrated magnesium silicate having a chain structure, such as sepiolite.

Phyllosilicate mineral, namely smectite and talc, and chain clay mineral, namely sepiolite are dispersed in water respectively to prepare a 1% aqueous dispersion. The properties of the 1% aqueous dispersion are shown in Table 1.

In the 1% aqueous dispersion of hectorite and stevensite, minute particles of a particle diameter of less than 0.05 μm measured with Microtrack UPA, are dispersed in water and show high transparency of 90% transmissivity measured with a haze meter (HGH-2DP). Saponite has a particle diameter of 0.05 to 0.1 μm when dispersed in water. Though the particle diameter is slightly larger than those of hectorite and stevensite, saponite still shows high transparency of 90% transmissivity.

However, when dispersed in water, montmorillonite has a dispersed particle diameter exceeding 1 μm and a transmissivity of less than 50%. Accordingly montmorillonite is inferior in transparency to hectorite, stevensite and saponite. Even a 1% aqueous dispersion of sepiolite or talc having a particle diameter of 1 μm or more has a transmissivity of less than 50% because of the occurrence of sedimentation and turbidity, which means inferior in transparency.

A clay mineral having layered structure is negatively charged due to isomorphous substitution of metal ions and therefore has a large cation-exchange capacity. Such a layered clay mineral swells when dispersed in water, due to the change of the surface charge distribution, and forms a stable colloidal solution-like dispersion. Table 1 shows that hectorite, saponite and stevensite have high transmissivity and form stable dispersions.

Phyllosilicate minerals with a particle diameter of more than 0.1 μm during the dispersion, such as chain clay minerals and talc, which are poorly transmissive when dispersed in water, certainly precipitate or sediment with the lapse of time. In the end precipitation and sedimentation occur in pipings and so on, causing accumulation and nozzle clogging.

The phyllosilicate mineral of the present invention includes kaolinite, pyrophyllite, smectite (saponite, hectorite, stevensite, beidellite), vermiculite, mica clay mineral, glauconite and chlorite preferably and more preferably smectite. Among smectite, saponite, hectorite and stevensite are particularly preferable.

The aqueous die lubricant contains the phyllosilicate mineral at a concentration of 0.005 wt % or more and less than 5 wt %, and at a concentration of 0.005 to 3 wt % preferably.

When dispersed in water, the phyllosilicate mineral of the present invention has a particle diameter of 0.1 μm or less and 0.05 μm or less preferably, in an aqueous dispersion. It is easier to disperse the phyllosilicate mineral as aquatic particles become minuter. And such dispersibility works in favor of preventing precipitation and sedimentation, so that the phyllosilicate mineral is suitable for the present invention.

For example, when hectorite is added to water, hectorite enters into the water in the form of minute particles almost invisible and the aqueous dispersion shows transparent and liquid form. Though the aqueous dispersion becomes a dry film when the water evaporates, the dry film is dispersed again when water is poured in; therefore this is the advantage of preventing nozzles from clogging. The aqueous dispersion remains unchanged for over two months after it is prepared, and no precipitation or sedimentation is observed. Hectorite is an inorganic powder and does not decompose even at 650 to 720° C. equivalent to the temperature of molten metal. A film of the aqueous die lubricant formed on the whole surface of a mold in contact with molten metal contains hectorite which resists thermal decomposition. Therefore the film of the aqueous die lubricant on the whole contact surface of the mold and molten metal prevents the mold from directly touching molten metal and making soldering.

TABLE 1

| | Smectite (Phyllosilicate Mineral) | | | | Chain Silicate Mineral | Phyllosilicate Mineral |
|---|---|---|---|---|---|---|
| | Hectorite | Saponite | Stevensite | Montmorillonite | Sepiolite | Talc |
| Particle Diameter | AA | A | AA | C | C | C |
| Transmissivity | AA | AA | AA | C | C | C |
| Heat Resistance | A | A | A | A | A | A |
| Stability | A | A | A | C | C | C |

Particle Diameter in 1% Dispersion AA: less than 0.05 μm, A: 0.05 μm or more and less than 0.1 μm, B: 0.1 μm or more and less than 1 μm, C: 1 μm or more
Transmissivity (%) AA: 90% or more, A: 70% or more and less than 90%, B: 50% or more and less than 70%, C: less than 50%
Thermal Insulation AA: less than 140° C., A: 140° C. or more and less than 160° C., B: 160° C. or more and less than 180° C., C: 180° C. or more
Stability (3 months at room temperature) A: no separation, B: turbidity, C: precipitation/sedimentation As shown in Table 1, the phyllosilicate mineral of the present invention not only has layered structure, but also has a particle diameter of 0.1 μm or less during the dispersion.

The aqueous die lubricant contains the phyllosilicate mineral and water. The water includes tap water, distilled water, deionized water and pure water.

Besides the foregoing phyllosilicate mineral, the aqueous die lubricant may include the common ingredients of the aqueous die lubricant, such as a mold-releasing ingredient, a dispersing agent and other additives, as far as the effects of this invention are not impaired.

A mold-releasing ingredient includes silicone compounds, wax, mineral oil, oils and fats, and synthetic oil. The silicone compound includes silicone oil. The wax includes petroleum wax, such as paraffin wax, olefin wax, polyethylene wax and polypropylene wax; oxidized wax, such as oxidized polyethylene wax and oxidized polypropylene wax; natural wax, such as beeswax, carnauba wax and montan wax. The oils and fats include animal oil and vegetable oil. The synthetic oil includes polybutene and polyesters. The mold-releasing ingredient can be used alone or in a mixture of two or more.

An ingredient of dispersing agents will do as far as it can emulsify and disperse the foregoing mold-releasing ingredient in the water. While both ionic surfactants (i.e., anionic surfactant, cationic surfactant and amphoteric surfactant) and nonionic surfactant can be used, nonionic surfactant and anionic surfactant are preferable. The nonionic surfactants include polyoxyalkylene glycol, polyoxyalkylene alkyl ether, polyoxyalkylene allyl ether and polyoxyethylene sorbitan monooleate. The anionic surfactants include fatty acid soap and alkyl/allyl sulfonate. The ingredient of dispersing agents can be used alone or in a mixture of two or more.

An ingredient of dispersing agents may be contained to the extent that it can emulsify and disperse the mold-releasing ingredient in water. The content is 5 to 20 mass parts, for example, and 10 to 15 mass parts preferably, based on 100 mass parts of the mold-releasing ingredient.

Other additive ingredients include an antifoaming agent, corrosion inhibitor, antiseptic, antirust, viscosity improver and antioxidant.

There is no particular limitation on manufacturing the aqueous die lubricant in the present invention. The aqueous die lubricant can be preferably manufactured by adding a phyllosilicate mineral to a solution of a dispersing agent ingredient dissolved in water and mixing them homogeneously, and then further by adding a mold-releasing ingredient such as a silicone compound thereto and mixing them homogeneously.

The aqueous die lubricant of the present invention can be used in squeeze die casting, laminar flow (low-speed) die casting and common die casting, regardless of the sorts of die casting processes.

Die casting materials include non-ferrous metals such as aluminum, zinc and magnesium, and alloy thereof. The die casting is suitable for manufacturing automobile components with aluminum alloy.

EXAMPLES

Hereinafter, the present invention is described in more detail with reference to Examples and Comparative Examples. However, the present invention is not restricted thereto.

[Preparation of Aqueous Die Lubricants]

Aqueous die lubricants were prepared according to Examples 1 to 9 and Comparative Examples 1 to 7.

[Evaluation of Aqueous Die Lubricants]

(1) Stability

An aqueous die lubricant was visually observed and evaluated after settled at room temperature for six months.

The aqueous die lubricant was judged 'Good' (A) when no turbidity or sediment was recognized, 'Passing' (B) when precipitation occurred, and 'Failing' (C) when sedimentation and phase separation were observed. The stability of the aqueous die lubricant of Comparative Example 7, which was prepared by diluting silicone emulsion with 5-fold volume of water, was set as a standard (A) for relative evaluation.

The stability of a 50-fold diluted solution of the aqueous die lubricant prepared from its undiluted liquid was also visually evaluated in the same way. Evaluation was made three days after the diluted solution was prepared and settled.

(2) Thermal Insulation

The thermal insulation, in other words, the heat retention of molten metal was evaluated as follows, with apparatus shown in FIG. 1. A steel plate with built-in thermocouple 2 mm below the surface was heated to 300° C., and then an aqueous die lubricant was sprayed on the surface. Then, 100 ml of molten aluminum alloy (ADC12 described in JIS K 2219) at a temperature of 680° C. was poured into a ring placed on the steel plate. Temperature changes the thermocouple indicated were measured. Test conditions were shown in Table 2.

TABLE 2

| | |
|---|---|
| Amount (ml) of coating | 0.2 |
| Distance (mm) from spray nozzle to steel plate | 200 |
| Steel plate material | SKD61 |
| Shape of steel plate | 200 × 200 × 30 |
| Temperature (° C.) of steel plate | 300 |
| Alloy material | ADC12 |
| Temperature (° C.) of molten metal | 680 |
| Amount (ml) of molten metal | 100 |

The aqueous die lubricant was judged 'Excellent' (AA) when temperature has risen to less than 140° C., 'Good' (A) when temperature has risen to 140° C. or more and less than 160° C., 'Passing' (B) when temperature has risen to 160° C. or more and less than 180° C., and 'Failing' (C) when temperature has risen to 180° C. or more.

(3) Mold Releasability

Figure 2:
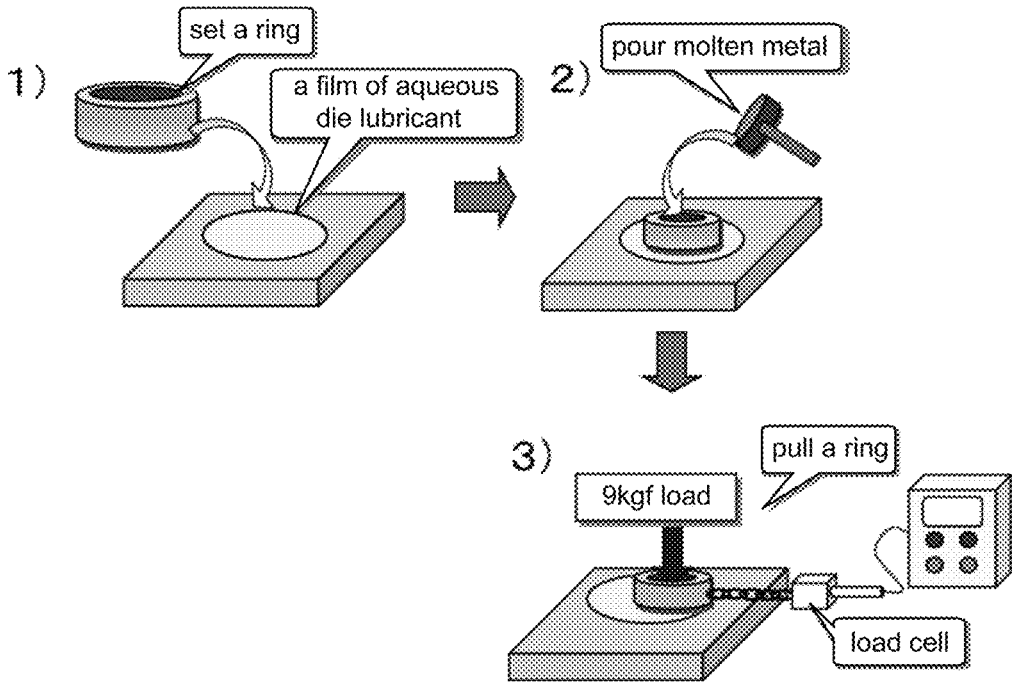
FIG. 2 is a schematic diagram explaining a method of evaluating the mold releasablity.

When the mold temperature becomes higher, a coating film adhered thereto is thermally decomposed. As a result, molten metal directly touches a mold and makes soldering on it. A steel plate coated with an aqueous die lubricant was heated to 350° C., and then was tested using a Lub tester to determine whether soldering of molten metal were observed or not. Table 3 shows test conditions and FIG. 2 shows test methods.

TABLE 3

| | |
|---|---|
| Amount (ml) of coating | 0.2 |
| Distance (mm) from spray nozzle to steel plate | 200 |
| Steel plate material | SKD61 |
| Shape of steel plate | 200 × 20 × 30 |
| Temperature (° C.) of steel plate | 350 |
| Alloy material | ADC12 |
| Temperature (° C.) of molten metal | 680 |
| Amount (ml) of molten metal | 100 |

The aqueous die lubricant was judged 'Good' (A) when no soldering was observed at 350° C. and 'Failing' (C) when soldering was observed. The mold releasability of the aqueous die lubricant of Comparative Example 7 was set as a standard (C) for relative evaluation.

Example 1

An aqueous die lubricant was prepared by mixing 0.05 mass part of hectorite, 20 mass parts of silicone emulsion (manufactured by Wacker Asahikasei Silicone Co., Ltd.; NR2707), and 79.95 mass parts of water together.

Stability, thermal insulation, and mold releasability of the obtained aqueous die lubricant were evaluated.

The results are shown in Table 4.

Example 2

An aqueous die lubricant was prepared in a manner similar to Example 1, except that saponite was used in place of hectorite.

The obtained aqueous die lubricant was evaluated in a manner similar to Example 1.

The results are shown in Table 4.

Example 3

An aqueous die lubricant was prepared in a manner similar to Example 1, except that stevensite was used in place of hectorite.

The aqueous die lubricant was evaluated in a manner similar to Example 1.

The results are shown in Table 4.

Example 4

An aqueous die lubricant was prepared by mixing 1 mass part of hectorite, 20 mass parts of silicone emulsion (manufactured by Wacker Asahikasei Silicone Co., Ltd.; NR2707), and 79 mass parts of water together.

The aqueous die lubricant was evaluated in a manner similar to Example 1.

The results are shown in Table 4.

Example 5

An aqueous die lubricant was prepared in a manner similar to Example 4, except that saponite was used in place of hectorite.

The aqueous die lubricant was evaluated in a manner similar to Example 1.

The results are shown in Table 4.

Example 6

An aqueous die lubricant was prepared in a manner similar to Example 4, except that stevensite was used in place of hectorite.

The aqueous die lubricant was evaluated in a manner similar to Example 1.

The results are shown in Table 4.

Example 7

An aqueous die lubricant was prepared by mixing 3 mass parts of hectorite, 20 mass parts of silicone emulsion (manufactured by Wacker Asahikasei Silicone Co., Ltd.; NR2707), and 77 mass parts of water.

The aqueous die lubricant was evaluated in a manner similar to Example 1.

The results are shown in Table 4.

Example 8

An aqueous die lubricant was prepared in a manner similar to Example 7, except that saponite was used in place of hectorite.

The aqueous die lubricant was evaluated in a manner similar to Example 1.

The results are shown in Table 4.

Example 9

An aqueous die lubricant was prepared in a manner similar to Example 7, except that stevensite was used in place of hectorite.

The aqueous die lubricant was evaluated in a manner similar to Example 1.

The results are shown in Table 4.

Each of the aqueous die lubricants of Examples 1 to 9 had good stability, thermal insulation and mold releasability. Above all, Examples 7 to 9 showed excellent thermal insulation, owing to a large amount of phyllosilicate minerals added in.

Comparative Example 1

An aqueous die lubricant was prepared by mixing 1 mass part of montmorillonite, 20 mass parts of silicone emulsion (manufactured by Wacker Asahikasei Silicone Co., Ltd.; NR2707), 1 mass part of a dispersing agent (CMC, NIPPON PAPER Chemicals CO., LTD.; F-20HC), 1 mass part of a surfactant (DKS Co. Ltd.; XL70) and 77 mass parts of water together.

The obtained aqueous die lubricant was evaluated in a manner similar to Example 1.

The results are shown in Table 4. Montmorillonite is swellable. In contact with water, it gets viscous because the interlayer cations are hydrated with water molecules. But as the dispersed montmorillonite is sedimented with the lapse of time, the stability is scarce.

Comparative Example 2

An aqueous die lubricant was prepared in a manner similar to Comparative Example 1, except that sepiolite (manufactured by SEPIO Japan; Milcon SP2) was used in place of montmorillonite.

The aqueous die lubricant was evaluated in a manner similar to Example 1.

The results are shown in Table 4. Sepiolite having unique chain-like and fibrous form becomes thixotropic when it is dispersed in water. But as sepiolite is sedimented with the lapse of time, the stability is scarce.

Comparative Example 3

An aqueous die lubricant was prepared in a manner similar to Comparative Example 1, except that talc (manufactured by Nippon Talc Co., Ltd.; MICRO ACE P-4) was used in place of montmorillonite.

The aqueous die lubricant was evaluated in a manner similar to Example 1.

The results are shown in Table 4. Talc has a particle diameter of more than 0.1 m during the dispersion and is insoluble in water. Therefore the aqueous dispersion with talc is deficient in stability and transparency.

Comparative Example 4

An aqueous die lubricant was prepared by mixing 5 mass parts of hectorite, 20 mass parts of silicone emulsion (manufactured by Wacker Asahikasei Silicone Co., Ltd.; NR2707), and 75 mass parts of water together.

The aqueous die lubricant was evaluated in a manner similar to Example 1.

The results are shown in Table 4. The aqueous die lubricant had excellent thermal insulation, because a large amount of phyllosilicate mineral, namely hectorite was added in. However, distinct gelation occurred and resulted in phase separation from silicone emulsion.

Comparative Example 5

An aqueous die lubricant was prepared in a manner similar to Comparative Example 4, except that saponite was used in place of hectorite.

The aqueous die lubricant was evaluated in a manner similar to Example 1.

The results are shown in Table 4. The aqueous die lubricant had excellent thermal insulation, because a large amount of saponite was added in. But the stability is scarce, because distinct gelation occurred with the lapse of time.

Comparative Example 6

An aqueous die lubricant was prepared in a manner similar to Comparative Example 4, except that stevensite was used in place of hectorite.

The aqueous die lubricant was evaluated in a manner similar to Example 1.

The results are shown in Table 4. The aqueous die lubricant had excellent thermal insulation, because a large amount of stevensite was added in. But the stability is scarce, because distinct gelation occurred with the lapse of time.

Comparative Example 7

An aqueous die lubricant was prepared by mixing 20 mass parts of silicone emulsion (manufactured by Wacker Asahikasei Silicone Co., Ltd.; NR2707), and 80 mass parts of water together. The obtained aqueous die lubricant was evaluated in a manner similar to Example 1.

The results are shown in Table 4.

TABLE 4

| | Ex. 1 | Ex. 2 | Ex. 3 | Ex. 4 | Ex. 5 | Ex. 6 | Ex. 7 | Ex. 8 | Ex. 9 | Comp. Ex. 1 | Comp. Ex. 2 | Comp. Ex. 3 | Comp. Ex. 4 | Comp. Ex. 5 | Comp. Ex. 6 | Comp. Ex. 7 |
|---|---|---|---|---|---|---|---|---|---|---|---|---|---|---|---|---|
| Hectorite | 0.05 | | | 1 | | | 3 | | | | | | 5 | | | |
| Saponite | | 0.05 | | | 1 | | | 3 | | | | | | 5 | | |
| Stevensite | | | 0.05 | | | 1 | | | 3 | | | | | | 5 | |
| Montmorillonite | | | | | | | | | | 1 | | | | | | |
| Sepiolite | | | | | | | | | | | 1 | | | | | |
| Talc | | | | | | | | | | | | 1 | | | | |
| Silicone Emulsion | 20 | 20 | 20 | 20 | 20 | 20 | 20 | 20 | 20 | 20 | 20 | 20 | 20 | 20 | 20 | 20 |
| Dispersing Agent | — | — | — | — | — | — | — | — | — | 1 | 1 | 1 | — | — | — | — |
| Surfactant | — | — | — | — | — | — | — | — | — | 1 | 1 | 1 | — | — | — | — |
| Water | 79.95 | 79.95 | 79.95 | 79 | 79 | 79 | 77 | 77 | 77 | 77 | 77 | 77 | 75 | 75 | 75 | 80 |
| Total | 100 | 100 | 100 | 100 | 100 | 100 | 100 | 100 | 100 | 100 | 100 | 100 | 100 | 100 | 100 | 100 |
| Stability | A | A | A | A | A | A | A | A | A | C | C | C | C | C | C | A (standard) |
| Stability of Diluted Solution | A | A | A | A | A | A | A | A | A | C | C | C | A | A | A | A (standard) |
| Thermal Insulation | B | B | B | A | A | A | AA | AA | AA | A | A | A | AA | AA | AA | C |
| Mold Releasability | A | A | A | A | A | A | A | A | A | A | A | A | A | A | A | C (standard) |

Stability (6 months) A: no problem, B: precipitation occurred, C: sedimentation, phase separation or gelation Stability of Diluted Solution (3 days) A: no problem, B: precipitation occurred, C: sedimentation, phase separation or gelation Thermal Insulation AA: less than 140° C., A: 140° C. or more and less than 160° C., B: 160° C. or more and less than 180° C., C: 180° C. or more Mold Releasability A: no soldering was observed at 350° C., C: soldering was observed at 350° C.

Dispersing Agent CMC

The invention claimed is:

1. An aqueous die lubricant for die casting consisting essentially of a smectite phyllosilicate mineral an aqueous dispersion medium, and a mold-releasing ingredient; wherein the smectite phyllosilicate mineral, is dispersed at a concentration of 0.005 wt % or more and less than 5 wt % and has a particle diameter of 0.1 μm or less during the dispersion, and no other dry ingredients besides the smectite phyllosilicate are included.

2. The aqueous die lubricant according to claim 1, wherein the aqueous dispersion medium is water.

3. The aqueous die lubricant according to claim 2, wherein the water is selected from the group consisting of tap water, distilled water, deionized water and pure water.

4. The aqueous die lubricant according to claim 1, wherein the mold-releasing ingredient is selected from the consisting of silicone oil, paraffin wax, olefin wax, polyethylene wax, polypropylene wax, oxidized polyethylene wax, oxidized polypropylene wax, beeswax, carnauba wax, montan wax, animal oil, vegetable oil, polybutene and polyesters.

5. The aqueous die lubricant according to claim 1, wherein the smectite phyllosilicate mineral is dispersed at a concentration of 0.005 wt % or more and less than 3 wt %.

6. The aqueous die lubricant according to claim 1, wherein the smectite phyllosilicate mineral has a particle diameter of 0.0.5 μm or less.

* * * * *